US005488995A

United States Patent [19]

Kuwahara

[11] Patent Number: 5,488,995

[45] Date of Patent: Feb. 6, 1996

[54] MOBILE FIRE APPARATUS HAVING HOSE COUPLING-VEHICLE BRAKE INTERLOCK

[75] Inventor: Mark Kuwahara, Laguna Niguel, Calif.

[73] Assignee: Union Oil Company of California, Los Angeles, Calif.

[21] Appl. No.: 56,311

[22] Filed: Apr. 30, 1993

[51] Int. Cl.[6] ..... A62C 27/00

[52] U.S. Cl. ..... 169/24; 180/234; 280/99

[58] Field of Search ..... 169/14, 15, 24, 169/52, 54, 62, 70; 180/234; 280/98, 99; 285/93; 303/2, 3

[56] References Cited

U.S. PATENT DOCUMENTS

| | | | |
|---|---|---|---|
| 2,934,149 | 4/1960 | Bedford et al. | 169/15 |
| 3,180,423 | 4/1965 | Gibbs | 169/24 |
| 3,243,123 | 3/1966 | Inghram et al. | 169/24 X |
| 3,688,846 | 9/1972 | Lease | 169/62 X |
| 3,762,478 | 10/1973 | Cummins | 169/24 |
| 4,410,045 | 10/1983 | Whitman | 169/24 |
| 5,040,827 | 8/1991 | DeLange | 285/93 X |
| 5,090,871 | 2/1992 | Story et al. | 285/93 X |
| 5,145,014 | 9/1992 | Eberhardt | 169/15 X |

FOREIGN PATENT DOCUMENTS

| | | | |
|---|---|---|---|
| 2137312 | 2/1973 | Germany | 169/24 |
| 1191449 | 5/1970 | United Kingdom | 169/24 |
| 2168015 | 6/1986 | United Kingdom | 169/24 |

OTHER PUBLICATIONS

Technical Bulletin 55, 1991, Williams Fire, 1992.

Industrial Fire World, Oct.–Nov., 1989, "Apparatus Pumping Capabilities in the Future" by David R. White, pp. 22–24.

NFPA 11C, Standard for Mobile Foam Apparatus, 1986 Edition, pp. 11C1–11C14.

*Primary Examiner*—Andrew C. Pike

*Attorney, Agent, or Firm*—William O. Jacobson; Yale S. Finkle; Gregory F. Wirzbicki

[57] ABSTRACT

A fire fighting vehicle provides the capability to access obstructed areas, to quickly connect to fire water sources, to discharge large amounts of water and/or foam to fight major industrial fires, and to be capable of repositioning while fighting these fires. The vehicle is adapted from a boom truck chassis and mounts a large flow rate capability fire monitor in a position to provide maximum orientation flexibility.

12 Claims, 3 Drawing Sheets

MOBILE FIRE APPARATUS HAVING HOSE COUPLING-VEHICLE BRAKE INTERLOCK

FIELD OF THE INVENTION

This invention relates to mobile fire protection devices and processes. More specifically, the invention is concerned with providing a fire protection vehicle for commercial/industrial locations such as refineries.

BACKGROUND OF THE INVENTION

Many petrochemical facilities, such as refineries, involve the storage and handling of large quantities of combustible materials, such as hydrocarbon fluids. Hydrocarbon fluids are typically stored in large storage vessels and processed in a complex and interconnecting network of piping, pumps, heat exchangers, and reactor vessels at these facilities.

Fire protection at these facilities presents a difficult challenge. The labyrinth of interconnecting piping and equipment can limit the effectiveness of fixed water spray installations and restrict access of mobile fire fighting equipment. These problems are compounded by the large quantities of combustible materials at these facilities, requiring bulky fire fighting equipment capable of high flow rates of foam/water mixtures or other fire fighting fluids.

These problems have resulted in fire protection at these facilities being typically limited to perimeter protection provided by large capacity fixed or trailer mounted fire "monitors" (large swiveling fire nozzles) supplemented by smaller, more maneuverable vehicles. The smaller mobile equipment is useful for gaining access to small fires and for rescue operations, but smaller mobile equipment is not effective against a major fire. Instead, the fixed monitors are typically placed to provide perimeter protection, that is, placed to contain any fire within a perimeter around one portion of the facility. For example, a large hydrocarbon storage tank would be covered by foam or water streams from several monitors. If a fire in an adjacent portion of the facility erupted, the fixed fire monitors directed at the storage tank would prevent the fire from spreading across the perimeter and to the storage tank. This perimeter approach would essentially allow some fires to burn themselves out within the perimeter.

This type of fire protection exposes adjoining property and personnel to adverse impacts and added risks. Dense clouds of smoke can damage adjoining properties and harm personnel, as well as cause a traffic hazard and other problems. Burning embers and/or an explosion can carry the fire over any perimeter protection. For these and other reasons, it may be desirable to extinguish a major fire instead of providing perimeter protection.

However, in addition to access limitations, other limitations prevent large truck and trailer mounted monitors (capable of fighting a major fire) from performing well in refinery fire applications. Because a tank on a truck or trailer would be quickly depleted by the large flow rates of water required, the truck or trailer mounted monitors must typically be supplied by attached fire hoses. In relatively open areas, a fire truck may be positioned near a hydrant, the hoses attached, and the truck repositioned towards the fire (dragging out hose behind it). However, this type of activity can damage hoses in the restricted access of a refinery even if the truck itself can manage to gain access (e.g., by jockeying back and forth). Hose setup and hose hookup near a major fire, due to the time involved, can expose fire fighters to risk. In addition, the reaction force of the large quantities of discharged water from the fire monitors can further limit the design and mobility of a large capacity truck or trailer, e.g., time consuming filling of tanks must be accomplished prior to water discharge so that the vehicle does not tip over when discharging.

SUMMARY OF THE INVENTION

Such problems and limitations are addressed by centrally mounting a large fire monitor on a small, "all-wheel" steerable, "all-wheel" drive vehicle The small, maneuverable fire vehicle is capable of gaining access to many areas of a refinery. Hoses may be quickly deployed and quick disconnect couplings attached to water supplies, allowing the vehicle to drag hoses to a better position to fight a fire. Retractable outriggers may be actuated for added stability once the vehicle is in the better position. If further repositioning is required, the "all wheel" drive and steerable vehicle can maneuver while fighting the fire.

BRIEF DESCRIPTION OF THE DRAWINGS

In these Figures, it is to be understood that like reference numerals refer to like elements or features.

DETAILED DESCRIPTION OF THE INVENTION

Figure 1:
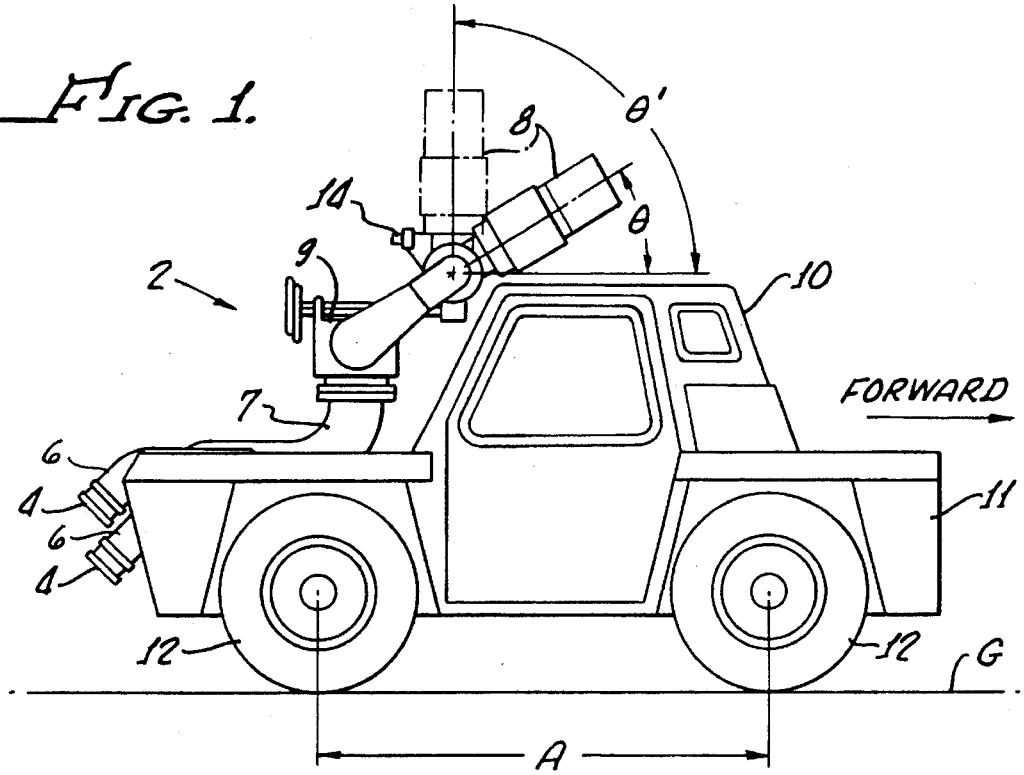
FIGS. 1, 2 and 3 show a side, rear, and top view respectively, of a fire vehicle.
Figure 2:
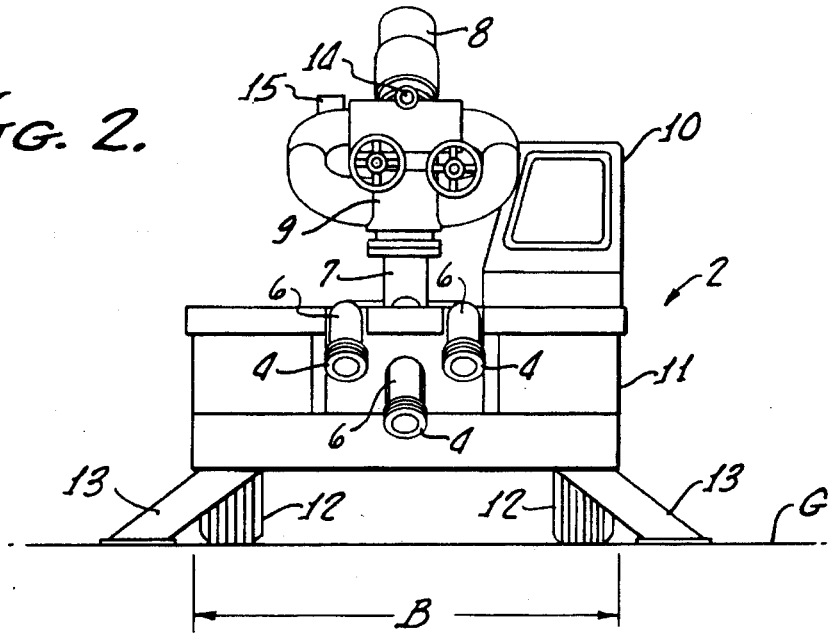
Figure 3:
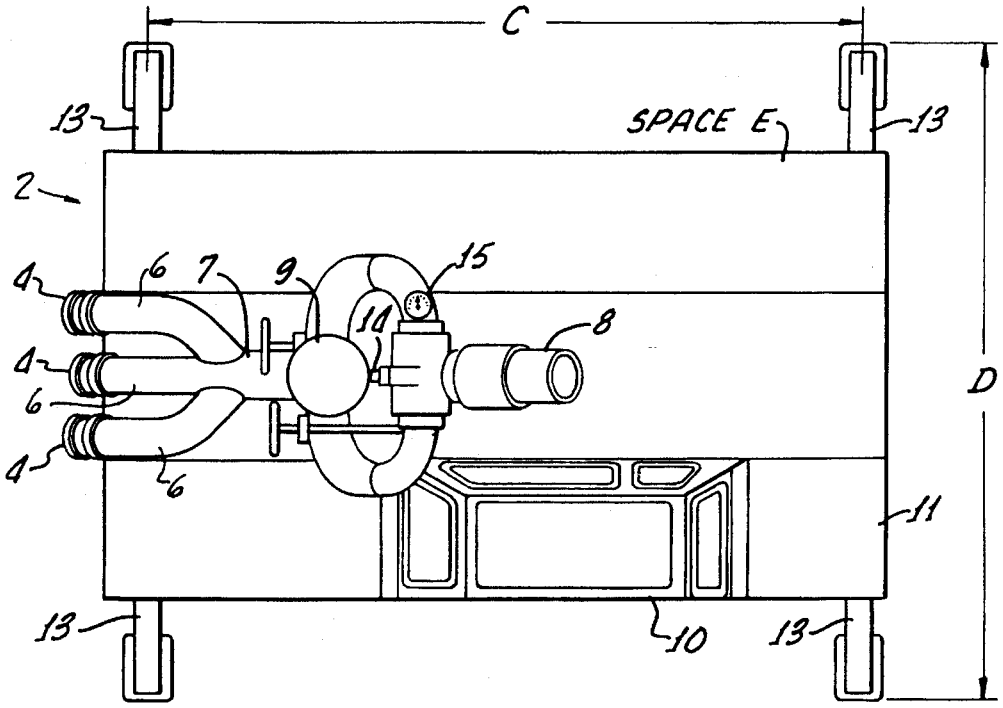

FIGS. 1, 2, and 3 are side, end, and top views of a mobile fire protection apparatus 2. Fire hoses, not shown but similar to hoses 3 (which may or may not be mounted on reels 5) shown on FIG. 4, supply the three water couplings 4 shown in FIGS. 1, 2 and 3. The couplings 4 are attached to supply lines 6 which feed header 7. A swivelling fire monitor 9 allows pressurized water to be discharged from nozzle 8 in various directions. The nozzle 8 is shown in a partially elevated orientation (at angle $\Theta$ to the horizontal) and alternatively (shown as dotted) in a nearly vertical direction (angle $\Theta'$ is approximately 90 degrees). The vertical orientation of nozzle 8 can range from near horizontal through vertical to near horizontal in the opposite direction. The horizontal orientation can range around an entire 360 degree arc with some limitation at or near an operator's cab or enclosure 10 on vehicle chassis 11.

Alternatively, the monitor 9 and nozzle 8 can be placed near one end or side of the chassis 11 and the vertical and/or horizontal orientation restricted. For example, placing the nozzle near the front and restricting rearward orientation would tend to prevent the vehicle from overturning when discharging the large flowrates of water and/or foam.

The fluid handling equipment and vehicle operation is typically controlled by a vehicle operator in the operator enclosure 10. The short wheelbase chassis 11 is driven by both front and back pairs of wheels 12, each pair of which or each axle is also steerable. The steering of each axle may be independent or coupled to each other. The short wheelbase, "all wheel" steerable configuration allows navigation of the vehicle within the restricted confines of a refinery and the "all wheel" drive allows "off road" operation of the vehicle. This allows the fire vehicle to drag fire hoses or other fire fighting equipment while maneuvering around or over obstacles. In addition, the fire monitor 9 is mounted relatively close to the ground, and the nozzle orientation can be brought to nearly horizontal to allow clearance under piping racks or other elevated obstructions in a refinery.

The nominal wheelbase length "A" of the mobile fire vehicle 2 shown in FIGS. 1, 2, and 3 is about 9 feet (2.74 meters), but can typically range from about 5 to 20 feet (1.524 to 6.096 meters), preferably at least about 7 feet (2.1336 meters) and no more than about 10 feet (3.048 meters). The nominal wheelbase width "B" of the mobile fire vehicle 2 is about 5 feet, 5 inches (1.651 meters), but can typically range from about 4 to 12 feet (1.2192 to 3.6576 meters), preferably at least about 5 feet (1.524 meters) and no more than about 7 feet (2.1336 meters). This range of wheelbase dimensions provides a stable platform for large-flow-rate fire-fighting equipment while still providing a small, maneuverable vehicle which can gain access to most areas of a typical refinery.

To provide additional support when discharging fire fighting fluids, retractable outriggers 13 are also attached to the chassis 11 (outriggers shown retracted in FIG. 1 and are extended in FIG. 2. The outriggers 13 avoid the need for weight carrying and/or filling tanks to prevent nozzle reaction forces from overturning the vehicle. The nominal length "C" (from centerpoint of one ground contact point to a distal ground contact point) of the extended outriggers 13 is eleven feet, three inches (3.429 meters) and the nominal width "D" (from outermost ground contact points) is nine feet, seven inches (2.921 meters), but outrigger length can typically range from about 8 to 20 feet (2.4384 to 6.096 meters) and outrigger width can typically range from about 5 to 15 feet (1.524 to 4.572 meters). The outriggers can supplement the weight carrying ability of the tires (if the outriggers can lift the vehicle's weight off the tires) or entirely support the vehicle. Each outrigger's nominal "footprint" (ground contact area of each outrigger) is about 5 by 12 inches (12.7 by 30.48 cm), but can typically range from about 3 by 8 inches (7.62 by 20.32 cm) to about 7 by 24 inches (17.78 by 60.96 cm).

The central and relatively low placement of nozzle 8 on the chassis 11 further minimizes vehicle overturning tendencies while allowing maximum range of nozzle orientations. Nominal placement of the (equivalent reaction point of the) nozzle is within 6 feet (1.829 meters) of the ground and near the center of the wheelbase and/or outrigger placement points, but the nozzle can typically be elevated from about 4 feet (1.2192 meters) to 20 feet (6.096 meters) off the ground, preferably less than 10 feet (3.048 meters), more preferably less than 8 feet off the ground. This can be compared to previous placement of swivel mounted nozzles in fire trucks approximately 10 feet (3.048 meters) off the ground and at least about 8 feet (2.4384 meters) off the ground. The nozzle attachment area is nominally within about one foot (0.3048 meters) of the center of the vehicle, typically within about 3 feet (0.9144 meters) of the center of the vehicle.

In the preferred embodiment, the chassis is derived from an IC-80, D-series, enclosed option 30 mobile crane or boom truck supplied by the Broderson Manufacturing Corp., located in Lenexa, Kans. By removing the lifting boom and counterweight, a low profile, 4-wheel drive, "all wheel" steering, outrigger equipped, and stable chassis for a large capacity fire monitor is provided. Although the outriggers and nozzle orientation can be manually actuated, an operator enclosure and hydraulic system for actuating and controlling the outriggers and nozzle orientation is also provided by the chassis.

The chassis allows substantially the same visibility in both the forward and aft directions. Controls are operable when the vehicle operator (in enclosure 10) is facing either forward or aft. The placement of the enclosure 10 at the side of the vehicle also allow discharge of fluids from the nozzle over a range of substantially forward directions without being impeded by the enclosure. Alternatively, the operator enclosure 10 may be deleted if protection afforded by the enclosure is not needed or an even greater freedom of nozzle orientation is desired.

A 2×6 fire monitor (i.e., having a discharge range from 2000 gpm ×6000 gpm) supplied by Williams Fire & Hazard Controls, located in Port Neches, Tex., and described in Technical Bulletin #55 and herein incorporated by reference, is swivelly mounted on the Broderson IC-80 Chassis (after the boom and the counterweight is removed). The fire monitor includes a 3" nominal diameter foam pick up hose connection or coupling 14 and a pressure gauge 15. An alternative embodiment retains the boom counterweight as a reaction force counterweight, e.g., mounting the nozzle 8 above a swivel-mounted counterweight.

Fluid handling equipment, e.g., supply lines 6, is also mounted on the chassis 11. The placement of the fluid handling equipment allows convenient fire hose access to quickly attach the fluid supply to couplings 4 at one end of the chassis 11 without limiting the orientation of the nozzle 8. The water coupling placement near the rear of the vehicle 2 also allows the hoses to be dragged when the vehicle advances towards the fire.

The placement and type of fire hose couplings used allow quick connection and disconnection to a hydrant. Although setup time can theoretically be measured in seconds, because of the large diameter hoses and weight of the fittings used, and the multiple connections needed, a significant amount of setup time is expected. For the embodiment shown in FIGS. 1, 2, and 3, a typical connection time is expected to be no more than about 15 minutes, but can typically range from about 5 to 25 minutes. Typical disconnect time is expected to be no more than about 40 minutes.

Figure 4:
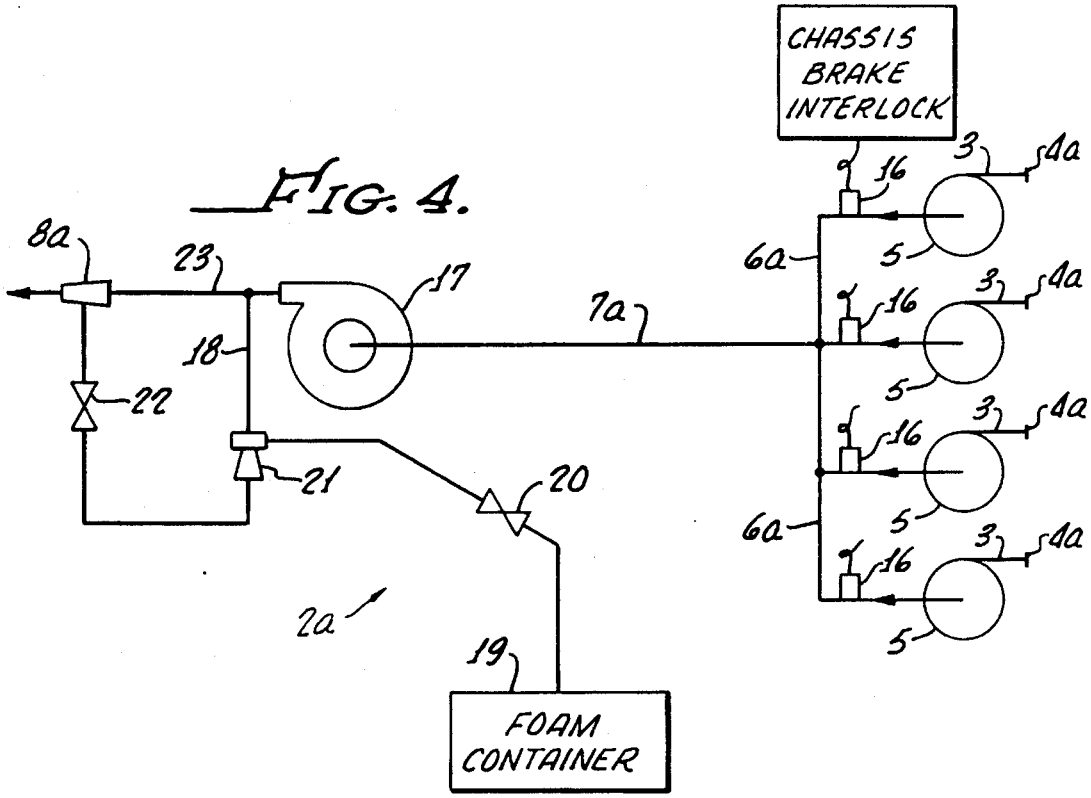
FIG. 4 shows a flow schematic of a fire vehicle.

Because of the relatively flat upper surface of the Broderson IC-80 chassis, alternative embodiments of the vehicle may carry or be modified to include ready access to other fire fighting or rescue apparatus, for example located at open area or stowage space "E". Space "E" is placed at the readily accessible height of less than four feet (1.2192 meters) of the ground surface "G" and nominally covers about 50 $ft^2$ (4.645 square meters). Although a portion of this space must be kept clear of other apparatus which would interfere with the swiveling motion of the nozzle, a minimum of about 25 $ft^2$ (2.323 square meters) clear area is preferable. This other apparatus may include a foam concentrate tank (similar to tank 19 as shown in FIG. 4), hoses and/or hose reels, hose fittings and adapters, retainers, and a rescue enclosure for a stretcher, winches, portable fire resistant barriers, air pack breathing apparatus, and other tools and hardware. This other apparatus may also be placed at different locations with respect to the center of the vehicle to provide further access and/or stability during vehicle maneuvering or water discharging operations.

FIG. 4 shows a fluid flow schematic on board an alternative fire-fighting vehicle for fighting major commercial or industrial facility fires, e.g., a refinery fire. Other fluid flow configurations are possible, including those similar to schematics disclosed in "Mobile Foam Apparatus", National Fire Codes, National Fire Protection Association, Batterymarch Park, Quincy, Mass. 02269, NFPA 11c, 1986 edition, which is herein incorporated by reference. In the schematic shown in FIG. 4, water or other noncombustible combustible fire-fighting fluid is supplied from one or more hydrants or other sources (not shown).

Typically, water is supplied through several large capacity fire hoses 3 connected by couplings 4*a*. Typically, 5-inch (12.7-cm) nominal diameter hoses and couplings are used, but nominal diameters can typically range from about 3 to 10 inches (7.62 to 25.4 cm), preferably at least about 4 inches (10.16 cm) in diameter, to supply a large capacity fire monitor. Similarly, a nominal hose length is 100 feet (30.48 meters), but lengths can typically range from about 25 to 200 feet (7.62 to 60.96 meters).

Since one hose and coupling may be insufficient to supply the large capacity mobile apparatus, a plurality of supply hoses 3 are mounted on takeup reels 5 and the hoses 3 feed supply lines 6*a*. Although four supply hoses and couplings are shown, the number can typically range from one to six or more.

In the embodiment shown, the fire hoses 3 are coiled and mounted on optional takeup reels 5. This allows the fire hoses 3 to be uncoiled from the takeup reels 5 and attached quickly to hydrants after the mobile apparatus 2*a* is brought near a supply (hydrant) and/or near a fire fighting position. If quick disconnect couplings are used, fire fighting can begin even more quickly and with only one connection to a fluid source. The takeup reels 5 are spring loaded, driven, or are otherwise actuated to reel and/or take up slack so that the mobile apparatus 2*a* can be quickly repositioned, e.g., by 1) disconnecting couplings 4*a* (and having the takeup reels 5 recover extended hoses), relocating, connecting to a different hydrant, and unreeling hose, or 2) relocating while feeding out or taking in hose while continuing to discharge fire fighting fluids. The takeup reels may also be actuated to unreel hose as well as takeup slack hose.

To further prevent damage to fire hoses and/or mobile apparatus during relocating process steps, optional transducers 16 are attached to supply lines 6*a*. The transducers 16 provide electrical or other signal indication (to the vehicle operator, not shown) that the supply lines are connected and supplying water. Alternatively, the transducers 16 can be mounted at the couplings 4*a* (to indicate coupled or uncoupled condition) or at the reels 5 (to indicate reeled or unreeled condition). The transducer indication can be used as a warning to the operator or to actuate a vehicle brake interlock preventing vehicle motion until repositioning can be accomplished without damage, e.g., hoses are uncoupled and reeled back or the interlock is manually overridden.

In the embodiment shown in FIG. 4, the supply lines 6*a* feed a common header 7*a* connected to the intake or suction of a large capacity centrifugal pump 17. A nominal six-inch (15.24-cm) header diameter is used, but other sizes or a plurality of headers can also be used. Typical performance for a single large capacity centrifugal pump 17 supplying a single fire monitor would be to supply 6,000 gpm (22,710 liters/minute) at about 100 psig (7.8 atmospheres) pressure when supplied with at least a nominal net positive suction pressure of water. For other applications, one or more centrifugal pumps would typically supply at least 2,000 gpm (7,570 l/min) at a minimum pressure of 100 psi (7.8 atm) but pump performance is not expected to exceed 10,000 gpm (37,850 l/min) at a maximum pressure of 125 psi (9.5 atm).

In other embodiments, multiple centrifugal pumps, e.g., three 50% pumps in a parallel flow arrangement, may be used to obtain greater reliability and/or greater range of performance. Other pumping means can also be used, such as vehicle mounted booster pumps or facility mounted centrifugal pumps.

Also supplied by the pump port and line 23 is a double suction foam stream driven by pressurized stream from the pump discharge within line 18. The pressurized stream in line 18 draws a foam concentrate from a mobile apparatus mounted tank 19 through metering valve 20 and first suction or eductor 21. Control valve 22 controls the portion of the high pressure fluid in pump discharge line 23 supplying the motive fluid for eductor 21. The nozzle 8*a* supplies the second suction by accelerating the discharge stream (and thereby lowering stream pressure). Thus, a means for drawing and discharging the foam concentrate and/or foam/water mixture is provided, i.e., a double suction.

Other means for supplying foam, foam concentrate, or other fluids, such as a separate metering or mixing pump or pumps, may also be used. Water alone, other additives, or alternative fire-fighting fluids may also be used. Alternative fire fighting fluids can include Hydrochem, a mixture of water and additive chemical supplied by Williams Fire & Hazard Controls.

The embodiment shown in FIGS. 1, 2, and 3 avoids the need for a pump when sufficient quantities of water are available at minimum supply pressures. Water can be supplied by a fire water system within the refinery and/or a separate truck mounted pumper. Minimum supply pressures to avoid the need for a fire vehicle mounted pump are typically at least 100 psi (7.8 atm) at a minimum flow rate of 2000 gpm (7,570 l/min), more preferably at a minimum flowrate of 6000 gpm (22,710 l/min).

Pressurized fluid is supplied to the nozzle 8*a* through pump discharge line 23. The nozzle 8*a* is typically swivel mounted such that it can be elevated and directed by an operator towards the fire without moving the vehicle, similar to that shown in FIGS. 1, 2, and 3. Nominal discharge flowrate of a single nozzle 8*a* for fighting a major industrial fire is preferably at least about 4000 gpm (15,140 l/min), more preferably at least about 6000 gpm (22,710 l/min), still more preferably at least about 8000 gpm (30,280 l/min). In addition, sprinklers for protecting the vehicle may also be supplied by a line (not shown) tee'd from the pump discharge 23 or other fluid supply.

Figure 5:
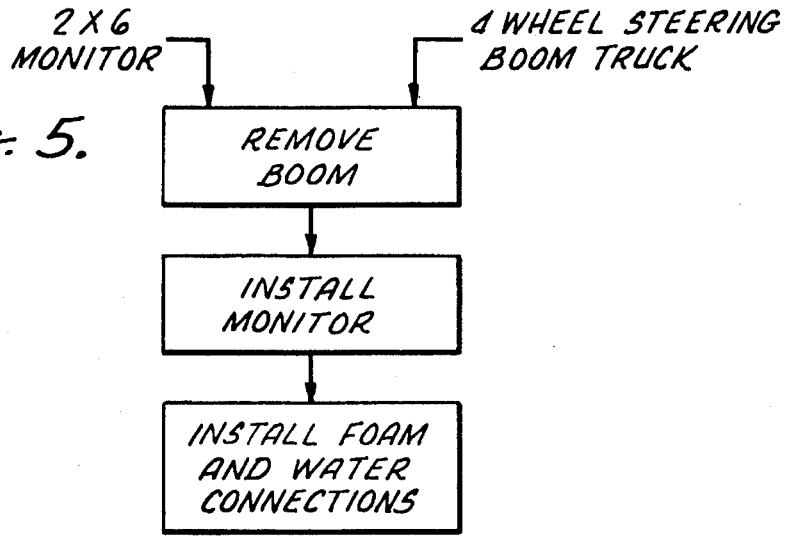
FIG. 5 shows a process flow chart for making the fire vehicle shown in FIGS. 1, 2 and 3.

A process of building the mobile fire apparatus is shown in FIG. 5. After obtaining a Broderson or other boom truck and verifying the capability to support fire fighting equipment and withstand discharge reaction forces, the boom (and related equipment) is removed, leaving a chassis. The chassis preferably has a relatively flat, low work area on top. The chassis is then modified to mount a fire monitor on the work area, preferably near the center or slightly aft of center. The related fire hose connections and fluid handling equipment are also installed on the chassis. Special attention in the assembly must be given to the location of the monitor and fluid supply connections in order to allow the discharge of the large amounts of fluids without overturning and to allow vehicle repositioning without damage to the hoses. Special attention in the assembly must also be given to structural loads generated by the equipment and reaction forces as well as the space required for swivelling nozzle.

Figure 6:
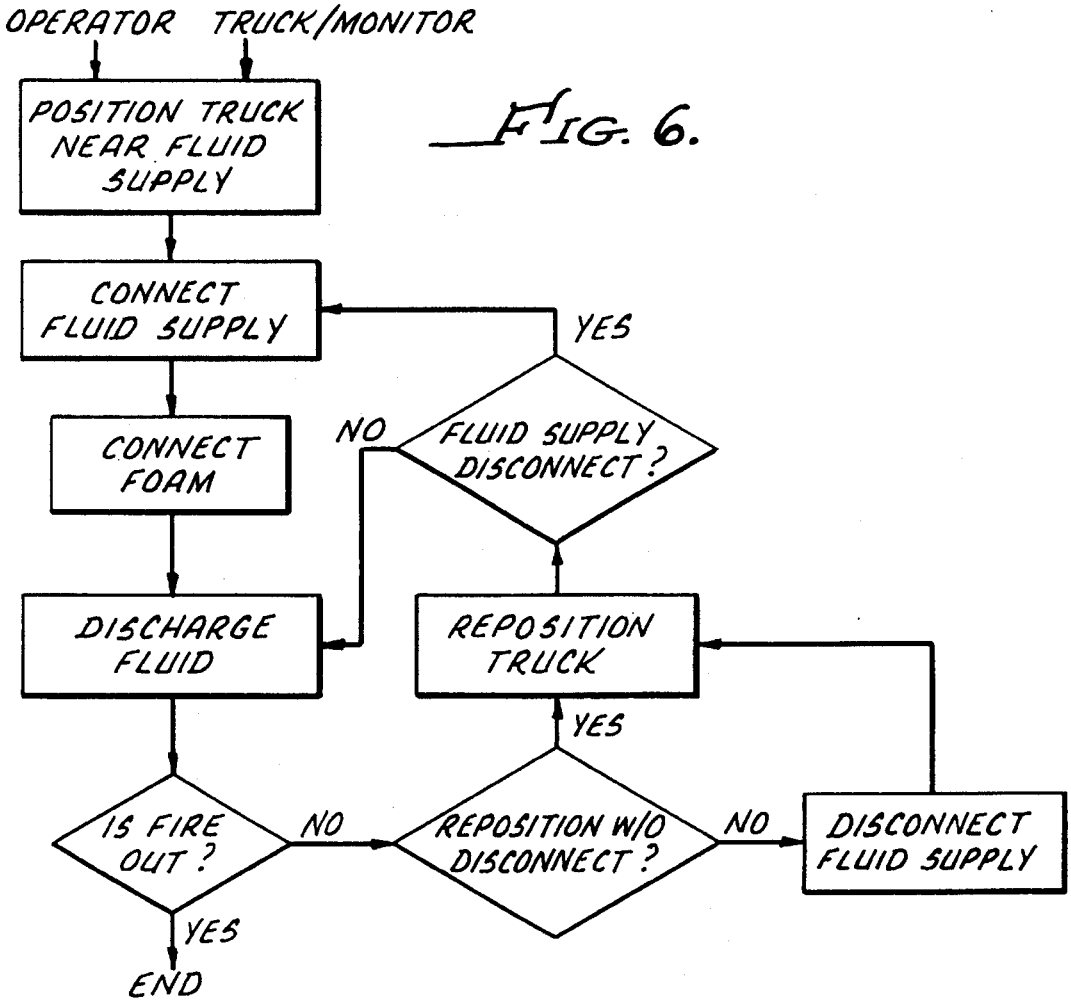
FIG. 6 shows a process flow chart for using the fire vehicle shown in FIGS. 1, 2 and 3.

The process of using the fire vehicle or truck is shown in FIG. 6. The truck with a fire monitor is first positioned to fight a fire and near enough a fluid supply, typically water, so that a fluid connection may be accomplished. The fluid connection is then made in the second step, e.g., fire hoses are connected between the truck and hydrants. Assuming foam is needed to fight the fire, connection to a foam concentrate source, e.g., a tank, is also accomplished. Large quantities of fire fighting fluid(s), e.g., a water/foam solution, are then discharged from a monitor onto the fire and/or onto threatened adjacent structures. If these quantities are sufficient to put out the fire or adjacent structures are no longer threatened, the fire truck may remain as a precaution against other threats/flareups or it may be desirable to return the truck to another position.

If only a portion of the fire is put out from this initial position of the fire truck, advancing toward the fire or other repositioning may be required. If advancing or other repositioning can be accomplished without disconnecting from the fluid supply, the fire truck can be repositioned while discharging fluids, e.g., while dragging fire hoses. If repositioning cannot be accomplished without disconnecting or other problems, e.g, insufficient length of fire hose available, disconnection from the fluid supply is accomplished. The disconnected fire truck is repositioned and connected (if required) to a fluid supply and the fire can be fought from this new position. The connected fluid supply may or may not be different from the connected fluid supply prior to repositioning. These process steps are repeated until the fire is out or the discharge of fluids from this vehicle is no longer needed.

The vehicle allows quick setup and repositioning to more effectively fight major industrial fires. The flat working surface which remains (even after installation of the fire monitor) also allows many other fire fighting options and embodiments.

Still other alternative embodiments are possible. These include: providing a plurality of large capacity, independently swivelling monitors and nozzles on the vehicle, providing a plurality of nozzles on the vehicle which swivel as a group, providing a fixed or restricted range of horizontal or vertical orientation monitor mounted on the vehicle (e.g, using the maneuverable vehicle itself for horizontal orientation of a fixed nozzle), and having the chassis composed of or protected by fire retardant materials.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A fire-fighting apparatus comprising:

a chassis;

means for discharging a fire-fighting fluid towards a fire;

a coupling connected to said means for discharging said fire-fighting fluid;

a transducer signalling a coupling status of said coupling; and a brake interlock on said chassis wherein said transducer signalling actuates said brake interlock when said coupling is coupled.

2. The fire-fighting apparatus of claim 1 wherein said chassis has at least two pairs of wheels supporting said chassis on a ground surface.

3. The fire-fighting apparatus of claim 2 further comprising means for steering each of said pairs of wheels.

4. The fire-fighting apparatus of claim 3 wherein each pair of wheels is separated by a wheel base length of no more than about 10 feet.

5. The fire-fighting apparatus of claim 4 wherein said means for discharging said fire-fighting fluid has a capacity for discharging of at least about 4000 gpm.

6. A fire-fighting apparatus comprising:

a chassis;

a fire monitor having a nozzle, said fire monitor swivel-mounted on said chassis;

a fire hose coupling fluidly connected to said fire monitor;

a transducer signalling a coupling status of said coupling; and a brake interlock on said chassis wherein said transducer signalling actuates said brake interlock.

7. The fire-fighting apparatus of claim 6 further comprising at least two pairs of wheels supporting said chassis on a ground surface, wherein both of said pairs of wheels are steerable and at least one wheel of both of said pairs of wheels is motor driven and said steerable wheels are coupled and controlled by a single operator.

8. A fire-fighting apparatus comprising:

a chassis;

a fire monitor having a nozzle, said fire monitor swivel-mounted on said chassis so that no portion of said fire monitor is higher than about 3 meters off a ground surface;

a fire hose coupling fluidly connected to said fire monitor, wherein said coupling comprises a plurality of parallel connected couplings attachable to a plurality of fire hoses connected to a source of fluid supply and each of said parallel connected couplings is a quick disconnect type having a nominal diameter of at least about 10 cm;

at least two pairs of wheels supporting said chassis off said ground surface, wherein both of said pairs of wheels are steerable and at least one wheel of both of said pairs of wheels is motor driven and said steerable wheels are coupled and controlled by a single operator;

a transducer signalling a coupling status of at least one of said parallel connected couplings; and a brake interlock on said chassis, wherein said transducer signalling actuates said brake interlock.

9. The fire fighting apparatus of claim 8 wherein said chassis has a wheelbase length of no more than about 3 meters and has a wheelbase width of no more than about 2 meters.

10. The fire-fighting apparatus of claim 9 which also comprises:

an operator enclosure attached to said chassis; and a relatively flat stowage area on the top of said chassis no more than about 1.2 meters off said ground surface and covering at least about 2 square meters.

11. The fire-fighting apparatus of claim 10 wherein said operator enclosure provides substantially equal visibility in both forward and aft directions and is located such that it does not impeded the discharge from said nozzle over a range of substantially forward and aft directions.

12. The fire-fighting apparatus of claim 8 which further comprises deployable outriggers attached to said chassis.

* * * * *